United States Patent [19]

Yamamoto et al.

[11] Patent Number: 4,770,721

[45] **Date of Patent: * Sep. 13, 1988**

[54] PROCESS OF TREATING STEEL FOR A VEHICLE SUSPENSION SPRING TO IMPROVE SAG-RESISTANCE

[75] Inventors: Toshiro Yamamoto, Tokai; Ryohei Kobayashi, Chita; Mamoru Kurimoto, Tokonabe; Toshio Ozone, Nagiya, all of Japan

[73] Assignees: Aichi Steel Works, Ltd.; Chuo Hatsujo Kabushiki Kaisha, both of Nagoya, Japan

[ * ] Notice: The portion of the term of this patent subsequent to Mar. 2, 2003 has been disclaimed.

[21] Appl. No.: 894,156

[22] Filed: Aug. 7, 1986

Related U.S. Application Data

[60] Division of Ser. No. 793,477, Oct. 28, 1985, abandoned, which is a continuation of Ser. No. 405,801, Aug. 6, 1982, abandoned.

[30] Foreign Application Priority Data

Aug. 11, 1981 [JP] Japan ..... 56-126282

[51] Int. Cl.[4] ..... C21D 9/02

[52] U.S. Cl. ..... 148/144; 148/150

[58] Field of Search ..... 140/143, 144, 12 B, 140/150, 2

[56] References Cited

U.S. PATENT DOCUMENTS 4,574,016 3/1986 Yamamoto et al. ..... 148/144
4,711,675 7/1985 Yamamoto et al. ..... 148/144

FOREIGN PATENT DOCUMENTS 54-117311 9/1979 Japan ..... 148/143

*Primary Examiner*—Deborah Yee
*Attorney, Agent, or Firm*—Blum Kaplan

[57] ABSTRACT

A spring steel having a good sag-resistance comprises by weight 0.5–0.8% carbon, 0.5–1.4% silicon, 0.5–1.5% manganese and a member or members selected from a group consisting of 0.05–0.5% vanadium, 0.05–0.5% niobium and 0.05–0.5% molybdenum, the remainder being iron together with impurities. The steel may further contain a member or members selected from a group consisting 0.0005–0.01% boron, 0.2–2.0% nickel and not greater than 0.3% rare-earth elements and/or a member or members selected from a group consisting of 0.02–0.1% titanium and 0.02–0.1% zirconium.

15 Claims, 4 Drawing Sheets

PROCESS OF TREATING STEEL FOR A VEHICLE SUSPENSION SPRING TO IMPROVE SAG-RESISTANCE

This is a divisional application of application Ser. No. 06/793,477, filed Oct. 28, 1985, which is a continuation of application Ser. No. 06/405,801 filed on Aug 6, 1982, both now abandoned.

BACKGROUND OF THE INVENTION

The present invention relates to a spring steel having a good sag-resistance.

There has been an increasing demand for light weight suspension springs reflecting a trend for light weight automobiles, in recent years. As an attempt to meet such a demand, it is said to be an effective approach to the reduction of weight to design the springs to have an increased stress and to use them under a high stress state.

However, if presently available spring steels are used under a high stress condition, there will arise problems such as deterioration of their durability and increase of sagging, and the increased sagging will result in decreased height of the springs and hence decreased height of the vehicle, with the consequent decreased height of the bumper causing a serious problem from the standpoint of safety.

Under the circumstances, there has recently been a demand for a spring steel having a high sag-resistance which makes high stress designing possible.

Heretofore, as a spring steel superior in sag-resistance, the steel corresponding to SAE 9260 (Japan Industrial Standard SUP 7) has become more popular along with the finding that silicon contained in spring steels is effective in improving sag-resistance. However, there were severe requirements for light weight suspension springs. Accordingly, it has been strongly desired to develop a spring steel having a sag-resistance superior to that of SAE 9260.

With these circumstances as background the inventors of the present invention have previously developed a spring steel superior in the sag-resistance to the steel of SAE 9260 and equivalent to the steel of SAE 9260 in the fatigue resistance and toughness required of spring steels, by adding one or more of vanadium, niobium and molybdenum in an appropriate amount to a spring steel of high silicon content, and filed an application thereon ( U.S. patent application Ser. No. 06/289,852).

In manufacturing such a high silicon content spring steel, it is sometimes required to perform the so-called reladling operation involving pouring molten steel into a ladle and then transferring it into another ladle, which operation results in increased cost. Moreover, it is known that an increased silicon content promotes decarburization of the steel surface, and particularly in the case of using the steel as rolled, it is necessary to exercise an ample care in its manufacture.

SUMMARY OF THE INVENTION

A primary object of the present invention is to provide a spring steel easy to manufacture and having a good sag-resistance.

Another object of the present invention is to provide a spring steel having an improved hardness and a high sag-resistance by adding an appropriate amount of one or more of vanadium, niobium and molybdenum to a silicon content spring steel.

A further object of the present invention is to provide a spring steel having an improved hardness and a high sag-resistance by adding, if required, boron, chromium, nickel and/or rare-earth elements to the aforementioned steel.

A still further object of the present invention is to provide a spring steel having an improved sag-resistance by adding to the aforementioned steel, if required, aluminum, titanium and/or zirconium to refine the grains, or adding and copper, cobalt and/or beryllium to make use of solution strengthening.

Thus the present invention provides a spring steel comprising, by weight, 0.5~0.8% carbon, 0.5~1.4% silicon, 0.5~1.5% manganese and a member or members selected from a group consisting of 0.05~0.5% vanadium, 0.05~0.5% niobium and 0.05~0.5% molybdenum, the remainder being iron except for impurities normally associated with these metals.

Further, the steel of the present invention may additionally contain a member or members selected from a group consisting of 0.0005~0.01% boron, 0.2~1.0% chromium, 0.2~2.0% nickel and not more than 0.3% rare-earth elements.

Still further, the steel of the present invention may additionally contain a member or members selected from a group consisting of 0.03~0.1% aluminum, 0.02~0.1% titanium and 0.02~0.1% zirconium or a member or members selected from 0.2~3.0% copper, 0.05~1.0% cobalt and 0.01~2.0% beryllium.

BRIEF DESCRIPTION OF THE DRAWINGS

A better understanding of the prior art and of the present invention will be obtained by reference to the attached drawings, in which.

DETAILED DESCRIPTION OF THE PREFERRED EMBODIMENTS

Figure 1:
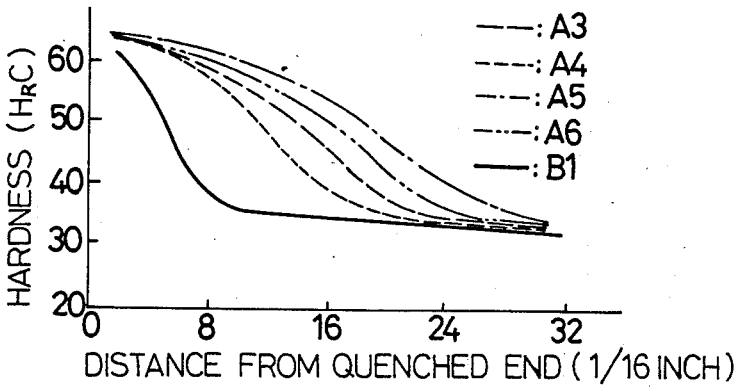
FIGS. 1 and 8 are diagrams illustrating hardenabilities of steels according to the present invention and that of the conventional steel.

The present invention relates to a spring steel having a good sag-resistance. The steel is a low silicon-content steel which fundamentally contains by weight 0.5~0.8% carbon, 0.5~1.4% silicon and 0.5~1.5% manganese and which further contains one or more element selected from 0.05~0.5% vanadium, 0.05~0.5% niobium and 0.05~0.5% molybdenum (this steel will be hereinafter referred to as the "first invention steel"). Further, the steel of the present invention may additionally contain 0.0005~0.01% boron, 0.2~1.0% chromium and 0.2~2.0% nickel (this steel will be hereinafter referred to as the "second invention steel"). The second invention steel is improved in hardenability and toughness from the first invention steel. Still further, the steel of the present invention may further contain, in addition to the components of the first invention steel, a member or members selected from a group consisting of 0.03~0.1% aluminum, 0.02~0.1% titanium and 0.02~0.1% zirconium (this steel will be hereinafter referred to as the "third invention steel").

The third invention steel is further improved in sag-resistance by refining the grains of the first invention steel. Still further, the steel of the present invention may further contain, in addition to the components of the third invention steel, a member or members selected from a group consisting of 0.0005~0.01% boron, 0.2~1.0% chromium, 0.2~2.0% nickel and not more than 0.3% rare-earth elements (this invention will be hereinafter referred to as the "fourth invention steel"). The fourth invention steel is improved in hardenability and toughness from the third invention steel. Still further, the steel of the present invention may further contain, in addition to the components of the first invention steel, a member or members selected from a group consisting of 0.2~3.0% copper, 0.05~1.0% cobalt and 0.01~2.0% beryllium (this steel will be hereinafter referred as the "fifth invention steel"). The fifth invention steel is further improved in sag-resistance from the first invention steel by utilizing a solution strengthening of the additional elements.

The following description is now provided about the function and effect of the elements incorporated in the steel of the present invention.

Vanadium, niobium and molybdenum form carbides in the steel. The vanadium carbide, niobium carbide and molybdenum carbide (hereinafter referred to as "alloy carbide") are dissolved in austenite by the heating at the time of the quenching operation, and when rapidly cooled for quenching, these elements are supersaturated in a martensite structure in a solid solution state. When tempered, a fine alloy carbide starts to reprecipitate during the tempering operation, whereby the movement of dislocation in the steel is prevented, and a secondary hardening takes place to give an increased hardness superior to the spring steel not incorporated with vanadium, niobium and molybdenum, and to improve the sag-resistance.

Moreover, an alloy carbide not dissolved in the austenite by the heating at the time of the quenching operation serves to refine austenite grains and prevent coarsening of the grains. Such fine grains serve to reduce the movement of dislocation and thereby to improve the sag-resistance.

Furthermore, the steel of the present invention thus incorporated with niobium, vanadium and molybdenum undergoes a secondary hardening by the reprecipitation of the alloy carbide in the tempering operation subsequent to the quenching operation which may be carried out from the austenitizing temperature of 900° C. normally used for the ordinary spring steels. This means that in the case of aiming at the same tempered hardness range, it is possible to obtain a wider temperature range for tempering as compared with a conventional steel and to obtain the aimed hardness assuredly.

As to silicon, its low content of 0.5 to 1.4% facilitates steel making and rolling operation and can avoid temper brittleness which a high silicon content steel is likely to undergo when tempered at a high temperature above 500° C.

Furthermore, boron, chromium, nickel and rare-earth elements function to enhance the hardenability of steel, thereby permitting application of the steel to springs formed of a thick wire rod or thick plate.

To make this point clearer, the below mentioned A3 steel containing 0.23% vanadium and 0.0041% boron, A4 steel containing 0.16% vanadium, 0.08% niobium and 0.0053% boron, A5 steel containing 0.22% vanadium, 0.57% chromium and 0.08% rare-earth elements, A6 steel containing 0.18% vanadium, 0.09% niobium, 0.63% chromium and 0.11% rare-earth elements and B1 steel corresponding to the conventional steel of SAE 9260 were compared with respect to their hardenability, the results of which are as shown in FIG. 1, from which it is seen that the addition of hardenability improving elements such as boron and chromium affords a hardenability superior to that of the conventional steel.

Figure 2:
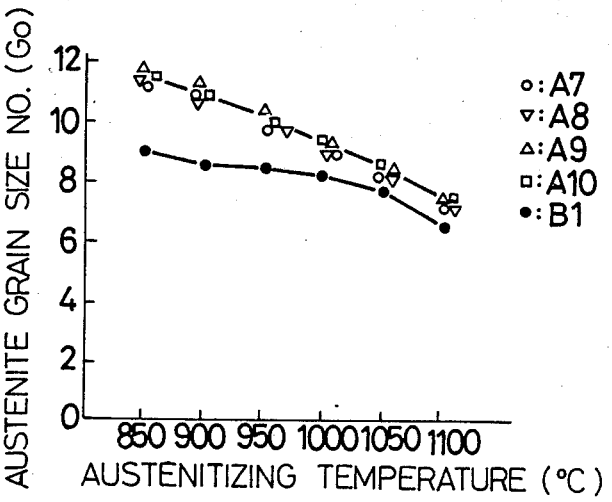
FIG. 2 is a diagram illustrating austenite grain sizes of A7 through A10 steels and B1 steel after heating at austenitizing temperatures ranging from 850° to 1,100°.

Aluminum, titanium and zirconium are in many cases bonded to nitrogen to form a nitride in the steel, which nitride functions to refine austenite grains in the hot rolling stage and prevent coarsening of the austenite grains when heated to an austenitizing temperature. In a structure wherein the grains are refined, the movement of dislocation is reduced, and therefore the sag-resistance of the steel can be improved. In this connection, the below mentioned A7 through A10 steels containing aluminum and titanium and the conventional B1 steel were heated and held at austenitizing temperatures of from 850° to 1,100° C., and austenite grain sizes under this heating condition are as shown in FIG. 2, from which the effect of adding the grain refining elements is clearly recognized.

Copper, cobalt and beryllium, like silicon, are substitutionwise dissolved in the steel to strengthen and improve the sag-resistance of the steel.

The following are reasons for the numerical limitations on the components of the steel of the present invention.

The reason for restricting the amount of carbon to 0.5~0.8% is that if the amount is less than 0.5%, a sufficient strength for use as a high-stress spring steel is not obtainable by quenching and tempering, and if the amount exceeds 0.8%, a hyper-eutectoid steel results which has a substantially reduced toughness.

The reason for restricting the amount of silicon to 0.5~1.4% is that if the amount is less than 0.5%, the effect of silicon of strengthening the matrix and improving the sag-resistance by being dissolved in ferrite is not fully attained, and if the amount exceeds 1.4%, the steel making and rolling operation become difficult as previously noted, and further there occur decarburization and temper brittleness at a high temperature.

The reason for restricting the amount of manganese to 0.5~1.5% is that if the amount is less than 0.5%, no adequate strength for a spring steel is obtainable and no adequate hardenability is obtainable, and if the amount exceeds 1.5%, the toughness tends to decrease.

Each of vanadium, niobium and molybdenum plays a role of improving the sag-resistance of the steel according to the present invention. The reason for restricting the amount of each of vanadium, niobium and molybdenum which fulfil such a function to 0.05~0.5% is that if the amount is less than 0.05%, the above effectiveness is not sufficiently obtainable, and if the amount exceeds 0.5%, the effectiveness is saturated and the amount of the alloy carbide not dissolved in the austenite increases and produces large aggregates acting as non-metallic inclusions thus leading to a possibility of decreasing the fatigue strength of the steel.

These vanadium, niobium and molybdenum may be added alone independently of the other two, or they may be added as a combination of two or three, whereby it is possible to form a preferred system where their solubilization in the austenite starts at a lower temperature than the case where vanadium, niobium and molybdenum are added alone, and the precipitation of the fine alloy carbide during the tempering operation facilitates the secondary hardening thereby further improving the sag-resistance.

The reason for restricting the amount of boron to 0.0005~0.01% is that if the amount is less than 0.0005%, no adequate improvements in the hardenability and sag-resistance are obtainable and if the amount exceeds 0.01%, boron compounds precipitate which leads to hot brittleness.

The reason for restricting the amount of chromium to 0.2~1.0% is that if the amount is less than 0.2%, no adequate effectiveness for hardenability is obtainable, and if the amount exceeds 1.0%, the uniformity of the structure is impaired in a silicon content steel as used in the present invention and consequently the sag-resistance is impaired.

Nickel and rare-earth elements function to improve the hardenability and toughness of the steel of the present invention. The reason for restricting the amount of nickel to 0.2~2.0% is that if the amount is less than 0.2%, the effect of improving the hardenability and toughness is not fully attained, and if the amount exceeds 2.0%, there is a possibility of forming a large amount of retained austenite in the quenching operation. Rare-earth elements, as well as nickel, also function to improve the hardenability and toughness of the steel, and the reason for restricting the amount thereof to not more than 0.3% is that an amount exceeding 0.3% is likely to cause coarsening of the grains.

Aluminum, titanium and zirconium function to refine the grains and thereby improve the sag-resistance of the steel of the present invention. The reason for restricting the amounts of aluminum, titanium and zirconium to 0.03~0.1%, 0.02~0.1% and 0102~0.1%, respectively, is that if their amounts are less than the respective lower limits, a sufficient effect of improving the sag-resistance is not obtainable, and if their amounts exceed the respective upper limits, the amount of nitrides of aluminum, titanium and zirconium increases and produces large aggregates acting as non-metallic inclusions thus leading to a possibility of decreasing the fatigue strength of the steel.

Copper, cobalt and beryllium are substitutionwise dissolved in the steel to strengthen and improve the sag-resistance of the steel. The reason for restricting the amount of copper to 0.2~3.0% is that an amount less than 0.2% is insufficient to strengthen the steel in a state of solid solution, and an amount exceeding 3.0% is likely to impair the hot rolling characteristic. The reason for restricting the amount of cobalt to 0.05~1.0% is that an amount less than 0.05% is not fully effective, and an amount exceeding 1.0% is likely to deteriorate the toughness. And the reason for restricting the amount of beryllium to 0.01~2.0% is that, although beryllium has a sufficient ability to strengthen the steel in a state of solid solution, if its amount is less than 0.01%, this effect is not obtainable, and if its amount exceeds 2.0%, the effectiveness is saturated as in the case of silicon.

Features of the steel of the present invention will be clarified hereinunder in terms of examples and in comparison with the conventional steel.

EXAMPLE 1

Table 1 below shows chemical compositions of sample steels.

TABLE 1

| | Chemical Compositions (% by weight) | | | | | | | | | | | |
|---|---|---|---|---|---|---|---|---|---|---|---|---|
| | C | Si | Mn | V | Nb | Cr | B | R.E.M. | Al | Ti | Cu | Co |
| A1 | 0.59 | 1.23 | 0.73 | 0.21 | | 0.10 | | | 0.021 | | | |
| A2 | 0.57 | 1.35 | 0.81 | 0.18 | 0.09 | 0.11 | | | 0.020 | | | |
| A3 | 0.57 | 1.12 | 0.83 | 0.23 | | 0.13 | 0.0041 | | 0.026 | | | |
| A4 | 0.58 | 1.05 | 0.84 | 0.16 | 0.08 | 0.13 | 0.0053 | | 0.017 | | | |
| A5 | 0.60 | 1.18 | 0.79 | 0.22 | | 0.57 | | 0.08 | 0.021 | | | |
| A6 | 0.58 | 1.12 | 0.88 | 0.18 | 0.09 | 0.63 | | 0.11 | 0.023 | | | |
| A7 | 0.59 | 1.30 | 0.78 | 0.22 | | 0.14 | | | 0.052 | | | |
| A8 | 0.62 | 1.21 | 0.77 | 0.18 | 0.10 | 0.12 | | | 0.044 | | | |
| A9 | 0.58 | 1.25 | 0.84 | 0.25 | | 0.12 | | | 0.023 | 0.07 | | |
| A10 | 0.59 | 1.21 | 0.88 | 0.17 | 0.08 | 0.13 | | | 0.018 | 0.08 | | |
| A11 | 0.57 | 1.25 | 0.78 | 0.28 | | 0.10 | 0.0026 | | 0.047 | | | |
| A12 | 0.61 | 1.13 | 0.91 | 0.15 | 0.10 | 0.12 | 0.0043 | | 0.038 | | | |
| A13 | 0.58 | 1.18 | 0.83 | 0.25 | | 0.10 | 0.0037 | | 0.020 | 0.08 | | |
| A14 | 0.58 | 1.15 | 0.79 | 0.20 | 0.09 | 0.11 | 0.0046 | | 0.019 | 0.08 | | |
| A15 | 0.60 | 1.03 | 0.86 | 0.24 | | 0.13 | | | 0.025 | | 0.51 | |
| A16 | 0.59 | 0.91 | 0.80 | 0.18 | 0.08 | 0.11 | | | 0.022 | | 0.57 | |
| A17 | 0.59 | 0.98 | 0.74 | 0.23 | | 0.10 | | | 0.023 | | | 0.75 |
| A18 | 0.58 | 1.05 | 0.82 | 0.17 | 0.09 | 0.11 | | | 0.020 | | | 0.70 |
| B1 | 0.59 | 2.11 | 0.86 | | | 0.13 | | | 0.023 | | | |

In Table 1, A1 through A18 steels are steels of the present invention, of which A1 and A2 steels correspond to the first invention steels, A3 through A6 steels correspond to the second invention steels, A7 through A10 steels correspond to the third invention steels, A11 through A14 steels correspond to the fourth invention steels and A15 through A18 steels correspond to the fifth invention steels, while B1 steel is a conventional steel corresponding to SAE 9260.

The sample steels A1, A2, A7 though A10, A15 through A18 and B1 shown in Table 1 were used as base materials. The base materials were cast and subjected to hot rolling at a reduction ratio of not lower than 50, coil springs having the characteristics as shown in Table 2 were prepared and then subjected to quenching and tempering treatments to bring the final hardness to be $H_RC$ 45 to 55. Then, they are subjected to pre-setting to bring the shear stress of bars to be $\tau=115$ kg/mm$^2$ thereby to obtain specimens for sagging test. These specimens were brought under a load sufficient to give a shear stress of the bars being $\tau=105$ kg/mm$^2$ at a constant temperature of 20° C., and after the expiration of 96 hours (hereinafter referred to as "long hour loading"), the sagging of the coil springs was measured.

TABLE 2

| Characteristics of Coil Springs | |
|---|---|
| Bar diameter (mm) | 13.5 |
| Bar length (mm) | 2470 |
| Average coil diameter (mm) | 120 |
| Number of turns | 6.75 |

TABLE 2-continued

| Characteristics of Coil Springs | |
|---|---|
| Effective number of turns | 4.75 |
| Spring rate (kgf/mm) | 4.05 |

Figure 3:
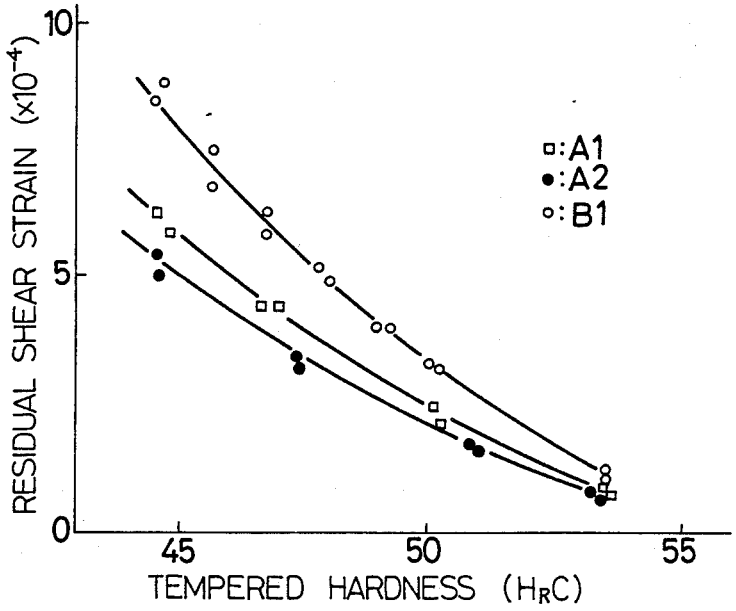
FIGS. 3 through 7 are diagrams illustrating saggings of specimens of $H_RC$ 45–55 obtained from steels according to the present invention and conventional steel after quenching and tempering treatments.
Figure 4:
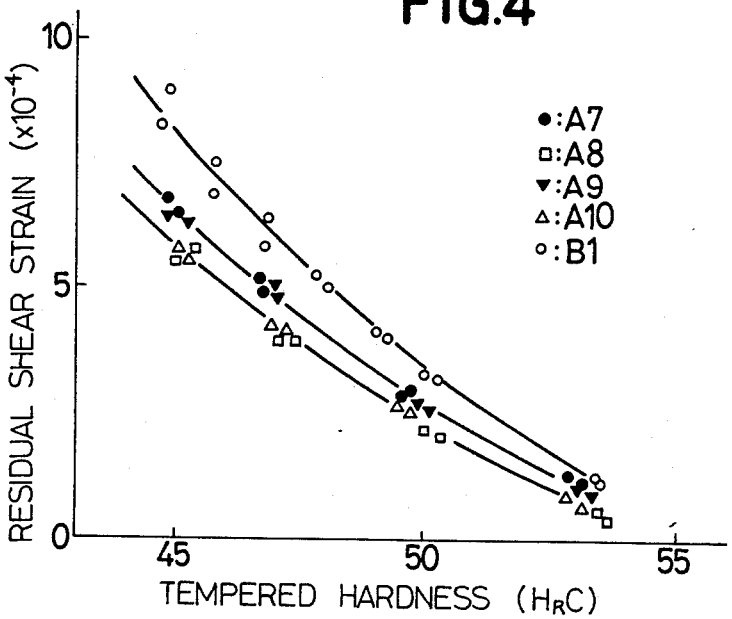
Figure 5:
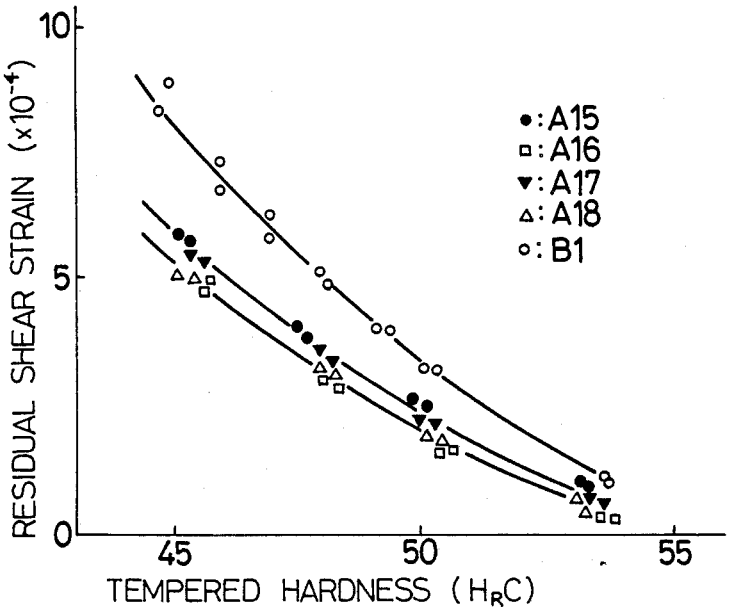

Further, the sagging corresponding to the hardness of the above specimens is as shown in FIGS. 3 through 5, from which it is apparent that the steels of the present invention containing aluminum and/or titanium and those containing copper and/or cobalt, in addition to vanadium and/or niobium, are all have a sag-resistance superior to that of the conventional B1 steel.

In order to determine the sagging, a load $P_1$ required to compress the coil springs to a predetermined level prior to the aforesaid long hour loading and a load $P_2$ required to compress them to the same level after exerting the long hour loading, were measured, and the sagging was calculated by applying the difference $\Delta P(=P_1-P_2)$ to the following equation, and sagging was evaluated by values having a unit of shear strain and referred to as "residual shear strain".

$$\gamma R = \frac{1}{G} \cdot K \frac{8D}{\pi d^3} \Delta P$$

G: Shear modulus (kgf/mm$^2$)
D: Average coil diameter (mm)
d: Bar diameter (mm)
K: Wahl's coefficient (a coefficient depending upon the shape of a coil spring)

Further, with respect to coil spring bars as above made of the sample steels A1, A2, A7 through A10, A15 through A18 of the present invention and of the conventional B1 steel as shown in Table 2, a load to give a shear stress varying from 10 to 110 kgf/mm$^2$ was repeatedly excerted for fatigue tests. Upon the repetition of the loading for 200,000 times, no breakage was observed in any one of the coil springs.

Using the sample steels A3 through A6, A11 through A14 and the conventional B1 steel shown in Table 1 as base materials, torsion bars having the characteristics shown in Table 3 and a diameter of 30 mm at the parallel portion were prepared, then subjected to quenching and tempering treatments to bring the final hardness to a level of $H_RC$ 45 to 55 and thereafter to a shot-peening treatment, thereby to obtain specimens for sagging tests. Prior to the sagging test, a torque to give a shear stress $\tau=110$ kgf/mm$^2$ to the surface of the parallel portion of the specimens was exerted to both ends of the specimens and a pre-setting was thereby applied. After the pre-setting, a torque to give a shear stress $\tau=100$ kgf/mm$^2$ was exerted and the specimens were kept to stand in that state for 96 hours. Thereafter, the residual shear strain was calculated by an equation $Y_R=\Delta\theta \cdot d/2l$ based on the decrease of the torsional angle, where $Y_R$ is a residual shear strain, $\Delta\theta$ is a decrease (rad) of the torsional angle and d is a diameter (mm) of the bar.

TABLE 3

| Characteristics of Torsion Bars | |
|---|---|
| Bar diameter | 30.0 mm |
| Effective bar length | 840 mm |
| Spring rate | 12,723 kgf mm/deg |

Figure 6:
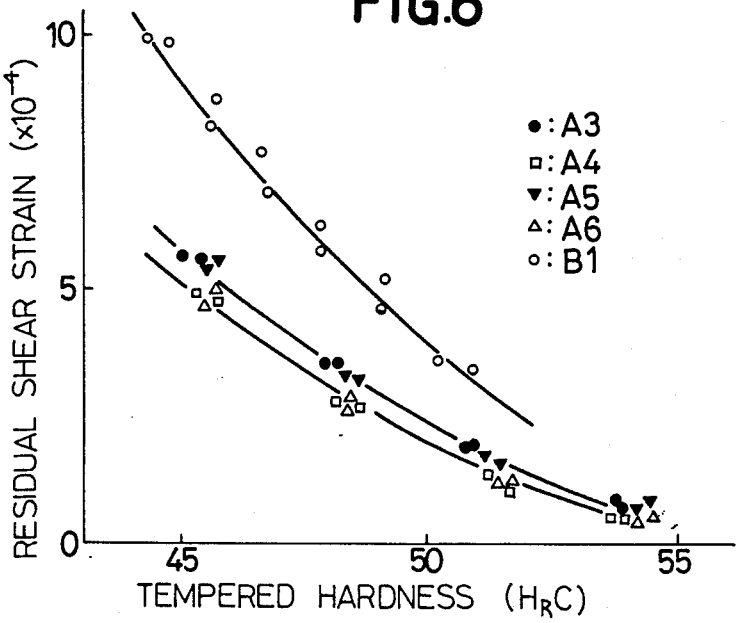
Figure 7:
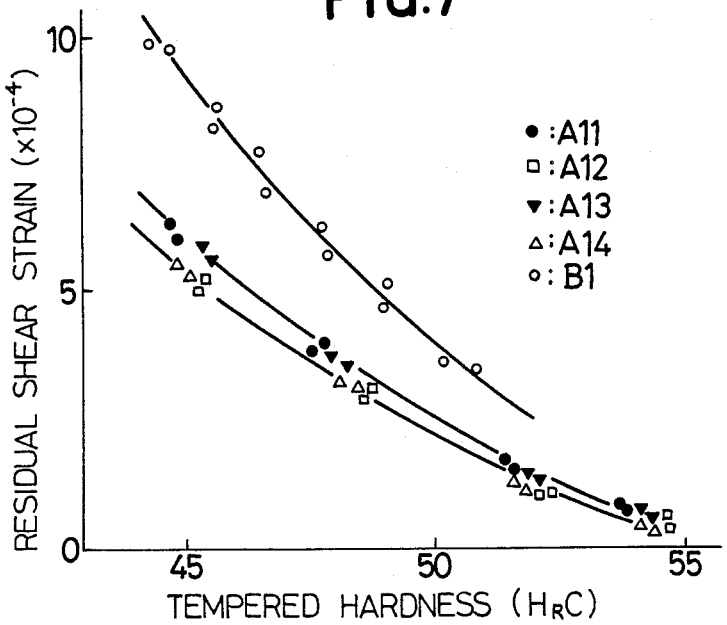

The sagging corresponding to the hardness of the above specimens is as shown in FIGS. 6 and 7, from which it is apparent that specimens having a diameter of 30 mm at the parallel portions and prepared from the sample steels A3 through A6 and A11 through A14 of the present invention containing boron, chromium and/or rare-earth elements are remarkably superior in the sagging to the conventional B1 steel.

This is presumed to be due to the fact that by the incorporation of boron, chromium and/or rare-earth elements, it was possible to obtain by the quenching treatment a fully hardened martensite structure to the core thereof without impairing the sag-resistance even when a torsion bar having a diameter of 30 mm was used, and at the same time boron penetrated interstitially into crystals in the vicinity of the dislocation thereby preventing the movement of the dislocation to effectively reduce the sagging.

Furthermore, with respect to the aforementioned torsion bars made of the sample steels A3 through A6, A11 through A14 of the present invention and of the conventional B1 steel, a load to give a shear stress of 60±50 kgf/mm$^2$ was repeatedly exerted for fatigue tests. Upon the repetition of loading for 200,000 times, no breakage was observed in any one of the torsion bars. This indicates that the addition of boron does not affect the fatigue life.

As described hereinabove, the steel of the present invention comprises a conventional silicon content spring steel in which proper amounts of vanadium, niobium and molybdenum are added alone or in combination, and which further contains, if required, one or more of boron, chromium, nickel and rare-earth elements, and which further contains, if required, aluminum, titanium and/or zirconium, or copper, cobalt and/or beryllium, whereby the hardenability and sag-resistance of the conventional silicon content spring steel have successfully been remarkably improved. At the same time, the steel of the present invention is as good as the conventional steels in the fatigue resistance and toughness which are required for spring steels, and it is extremely useful for practical applications particularly as a steel for a vehicle suspension spring.

Now, a high temperature rapid heating operation will be described which further improves the sag-resistance of the steel of the present invention.

Figure 8:
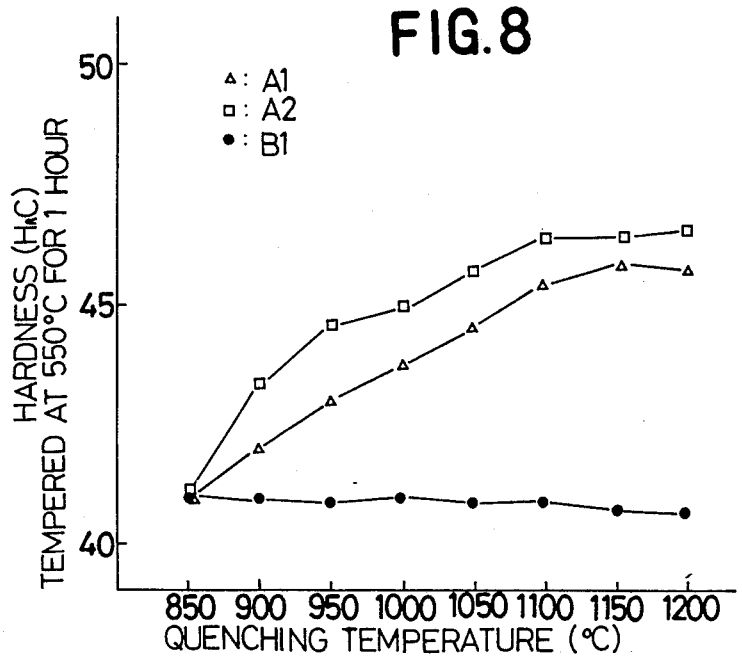

FIG. 8 shows the hardness of the above steels which were treated at austenitizing temperatures within a range from 850° to 1200° C. and tempered at 550° C. It is seen from FIG. 8 that with respect to A1 and A2 steels except for B1 steel, the hardness is increased with an increase of the austenitizing temperature. This indicates that the amount of the alloy carbide dissolved in the austenite phase increases with an increase of the austenitizing temperature and the secondary hardening is thereby facilitated remarkably. And further, it is apparent from FIG. 8 that the steel containing vanadium and niobium in a combination has a hardness superior to the steels in which vanadium or niobium is added alone.

Namely, by setting the heating temperature for austenitizing at a higher level of from 900° to 1200° C. than the conventional method, it is possible to increase the amounts of carbides of vanadium, niobium and molybdenum dissolved in the austenite. Accordingly, it is thereby possible to increase the precipitation of the fine carbides in the subsequent tempering and to further facilitate the secondary hardening, whereby it is possible to further improve the sag-resistance.

However, if the heating is conducted at a temperature as high as from 900° to 1200° C. for a long period of time by the conventional heating method such a with a heavy oil, there will be adverse effects such that decarburization takes places on the steel surface, the surface becomes rough, the fatigue life is shortened and the austenite grains are coarsened.

Under these circumstances, the present inventors have conducted extensive researches, and have found that by rapidly heating the steel materials to a temperature of from 900° to 1200° C. at the time of austenitizing, it is possible to dissolve carbides of vanadium, niobium and molybdenum in a great amount in the austenite without bringing about decarburization and surface roughening, and by holding the steel materials at the temperature for a predetermined period of time, thereafter quenching them and then subjecting them to tempering at a temperature of from 400° to 580° C., it is possible to precipitate fine carbides in a great amount to further facilitate the secondary hardening, whereby it is possible to further improve the sag-resistance.

Now, the reasons for restricting the high temperature rapid heating will be explained.

The reason for restricting the heating temperature for austenitizing to from 900° to 1200° C., is that if the temperature is lower than 900° C., it is impossible to adequately dissolve vanadium, niobium and molybdenum in the austenite especially when they are added alone, and if the temperature exceeds 1200° C., it is likely that decarburization or surface roughening forms on the surface of the steel materials.

Further the reason for carrying out the heating rapidly, is that if the heating rate is less than 500° C./min, the heating time at the high temperature is required to be long thereby leading to adverse effects such as the formation of decarburization on the surface of the steel materials, the surface roughening, the decrease of the fatigue life, and the coarsening of the austenite grains.

To carry out the rapid heating at a rate of at least 500° C./min, it is preferred to use a high frequency induction heater or a direct current heating apparatus.

Further, the reason for restricting the tempering temperature to from 400° to 580° C. is that in the steel of the present invention, carbides of vanadium, niobium and molybdenum dissolved in the austenite, are precipitated as a fine alloy carbide during the tempering treatment and a secondary hardening is thereby caused to take place, whereby even when the tempering is carried out at a temperature as high as 580° C., the decrease of the hardness is smaller than the conventional steels and it is possible to obtain a hardness of at least $H_RC$ 44.5.

This will be explained in more detail with reference to the following Example.

EXAMPLE 2

As the sample materials, there were used the steels of the invention identified by A2, A4, A8, A12 and A16 in Table 1 and the conventional steel identified by B1 also in Table 1 and composed substantially of SAE 9260.

The sample steels were cast, subjected to hot rolling at a rolling ratio of at least 50, and then rapidly heated at a heating rate of 1000° C./min or 5000° C./min to 950° C. and 1050° C. at the time of quenching and then tempered to give a tempered hardness of about $H_RC$ 48. The sagging (i.e. the residual shear strain), decarburization and austenite grain sizes thereby obtained are shown in Table 4.

The measurement of the sagging was carried out in the same manner as in Example 1 with use of coil springs in respect of materials having a diameter of 13.5 mm and with use of torsion bars in respect of materials having a diameter of 30 mm.

Further, the decarburization was measured by JIS G 0558 (SAE J 419) method, and the austenite grain sizes were measured by JIS G 0551 (ASTM E 112) quenching and tempering (Gh) method.

TABLE 4

| | Sample materials bar diameter (mm) | Heating rate (°C./min) | Austenitizing temperatures (°C.) | Tempering Temperatures (°C.) | Sagging ($10^{-4}$) (Residual shear strain) | Decarburization (mm) | Austenite grain sizes (Go) |
|---|---|---|---|---|---|---|---|
| | | | High temperature rapid heating | | | | |
| A2 | Coil spring 13.5 | 1000 | 950 | 470 | 3.1 | 0.01 | 11.2 |
| " | Coil spring 13.5 | 5000 | 1050 | 480 | 2.9 | 0.03 | 10.9 |
| A4 | Coil spring 13.5 | 1000 | 950 | 470 | 3.0 | 0.02 | 11.4 |
| " | Coil spring 13.5 | 5000 | 1050 | 480 | 2.7 | 0.03 | 10.7 |
| A8 | Coil spring 13.5 | 1000 | 950 | 470 | 2.8 | 0.02 | 11.8 |
| " | Coil spring 13.5 | 5000 | 1050 | 480 | 2.6 | 0.04 | 11.0 |
| A12 | Coil spring 13.5 | 1000 | 950 | 470 | 2.7 | 0.01 | 11.1 |
| " | Coil spring 13.5 | 5000 | 1050 | 480 | 2.4 | 0.02 | 10.8 |
| A16 | Coil spring 13.5 | 1000 | 950 | 470 | 2.8 | 0.02 | 11.2 |
| " | Coil spring 13.5 | 5000 | 1050 | 480 | 2.7 | 0.03 | 10.6 |
| A4 | Torsion bar 30 | 1000 | 1050 | 480 | 2.8 | 0.03 | 11.0 |
| A12 | Torsion bar 30 | 1000 | 1050 | 480 | 2.8 | 0.04 | 10.6 |
| | | | Conventional method | | | | |
| B1 | Coil spring 13.5 | 50 | 950 | 450 | 4.4 | 0.12 | 7.7 |
| " | Torsion bar | 50 | 950 | 450 | 6.1 | 0.17 | 7.0 |

TABLE 4-continued

| Sample materials bar diameter (mm) | Heating rate (°C./min) | Austenitizing temperatures (°C.) | Tempering Temperatures (°C.) | Sagging ($10^{-4}$) (Residual shear strain) | Decarburization (mm) | Austenite grain sizes (Go) |
|---|---|---|---|---|---|---|
| 30 | | | | | | |

As is apparent from Table 4, the sagging of the coil springs having a diameter of 13.5 mm and prepared by the high temperature rapid heating was $2.4–3.1\times10^{-4}$, whereas the sagging of the coil springs prepared under the conventional heating conditions was $4.4\times10^{-4}$ thus showing that the values obtained by the invention were much superior to those of the conventional method.

Likewise, the sagging of torsion bars having a diameter of 30 mm was $2.8\times10^{-4}$ thus indicating superior values equivalent to the above coil springs.

From the above, it is apparent that the springs prepared by applying the high temperature rapid heating to the above steels of the present invention, have a superior sag-resistance.

Namely, by the application of the high temperature rapid heating to the above steels of the present invention, it was possible to dissolve a great amount of carbides of vanadium, and niobium in the austenite and to precipitate a great amount of fine carbides in the subsequent tempering step, whereby the secondary hardening was facilitated and the sag-resistance was thereby improved.

When the heating rate was as high as 1000° C./min or 5000° C./min with use of the high temperature rapid heating, even if the heating was conducted at a temperature as high as from 950° to 1050° C., it was possible to supress the decarburization amount as low as from 0.01 to 0.04 mm as compared with from 0.12 to 0.17 mm according to the conventional method.

Further, if the high temperature rapid heating was applied to the above steels of the present invention, even when the heating was conducted at a temperature as high as 950° C. to 1050° C., it was possible to obtain an austenite grain size as fine as from 10.6 to 11.8 as compared with from 7.0 to 7.7 according to the conventional method, and thus a superior effect for the prevention of coarsening of austenite grains was obtainable.

As is apparent from the above results, in the case where a high temperature rapid heating is applied to the steel of the present invention, even when it is heated at a temperature as high as e.g. 1050° C., the decarburization amount is less than that by the conventional method and the austenite grain size is finer than attainable by the conventional method. Further, with respect to fatigue property, it has been confirmed that no breakage is observable in any one of the sample materials when they were subjected to a repeated loading for 200,000 times according to the fatigue test conducted by the method described in Example 1.

What is claimed is:

1. A process for improving the sag-resistance of an alloy spring steel for use in a vehicle suspension spring, comprising the steps of:

preparing an alloy spring steel consisting essentially of by weight 0.5–1.4% silicon, 0.5–0.8% carbon, 0.5–1.5% manganese and one or more members selected from the group consisting of 0.05–0.5% molybdenum, 0.05–0.5% niobium, and 0.05–0.5% vanadium, and the remainder being iron together with impurities;

rapidly heating the alloy spring steel to an austenitizing temperature between about 900° and 1200° C. for dissolving carbides of molybdenum, niobium and vanadium in the austenitic structure; and quenching and tempering the alloy spring steel at a tempering temperature between about 400° and 580° C. for precipitating dissolved carbides of molybdenum, niobium and vanadium as fine carbides of molybdenum, niobium and vanadium in a martensitic structure.

2. The process for improving the sag-resistance of steel of claim 1, wherein the steel is rapidly heated at a heating rate greater than about 500° C./min.

3. The process for improving the sag-resistance of steel of claim 1, wherein the steel is rapidly heated at a heating rate between about 1000° C./min and 5000° C./min.

4. The process for improving the sag-resistance of steel of claim 1, wherein the steel is heated by high frequency induction heating.

5. The process for improving the sag-resistance of steel of claim 1, wherein the steel is heated by direct current heating.

6. A process for improving the sag-resistance of an alloy spring steel for use in a vehicle suspension spring, comprising the steps of:

preparing an alloy spring steel consisting essentially of by weight 0.5–1.4% silicon, 0.5–0.8% carbon, 0.5–1.5% manganese, one or more members selected from the group consisting of 0.05–0.5% molybdenum, 0.05–0.5% niobium, and 0.05–0.5% vanadium, and one or more members selected from the group consisting of 0.0005–0.01% boron, 0.2–1.0% chromium, 0.2–2.0% nickel and less than or equal to about 0.3% rare earth elements, the remainder being iron together with impurities;

rapidly heating the alloy spring steel to an austenitizing temperature between about 900° and 1200° C. for dissolving carbides of molybdenum, niobium and vanadium in the austenitic structure; and quenching and tempering the steel at a tempering temperature between about 400° and 480° C. for precipitating dissolved carbides of molybdenum, niobium and vanadium as fine carbides of molybdenum, niobium and vanadium in a martensitic structure.

7. The process for improving the sag-resistance of steel of claim 6, wherein the steel is rapidly heated at a heating rate greater than about 500° C./min.

8. The process for improving the sag-resistance of steel of claim 6, wherein the steel is rapidly heated at a heating rate between about 1000° C./min and 5000° C./min.

9. The process for improving the sag-resistance of steel of claim 6, wherein the steel is heated by high frequency induction heating.

10. The process for improving the sag-resistance of steel of claim 6, wherein the steel is heated by direct current heating.

11. A process for improving the sag-resistance of an alloy spring steel for use in a vehicle suspension spring, comprising the steps of:

preparing an alloy spring steel consisting essentially of by weight 0.5–1.4% silicon, 0.5–0.8% carbon, 0.5–1.5% manganese, one or more members selected from the group consisting of 0.05–0.5% molybdenum, 0.05–0.5% niobium, and 0.05–0.5% vanadium, and one or more members selected from the group consisting of 0.0005–0.1% boron, 0.2–1.0% chromium, 0.2–2.0% nickel and less than or equal to about 0.3% rare earth elements, and one or more members selected from the group consisting of 0.03–0.1% aluminum, 0.02–0.1% titanium and 0.02–0.1% zirconium, the remainder being iron together with impurities;

rapidly heating the alloy spring steel to an austenitizing temperature between about 900° and 1200° C. for dissolving carbides of molybdenum, niobium and vanadium in the austenitic structure; and quenching and tempering the steel at a tempering temperature between about 400° and 580° C. for precipitating dissolved carbides of molybdenum, niobium and vanadium as fine carbides of molybdenum, niobium and vanadium in a martensitic structure.

12. The process for improving the sag-resistance of steel of claim 11, wherein the steel is rapidly heated at a heating rate greater than about 500° C./min.

13. The process for improving the sag-resistance of steel of claim 11, wherein the steel is rapidly heated at a heating rate between about 1000° C./min and 5000° C./min.

14. The process for improving the sag-resistance of steel of claim 11, wherein the steel is heated by high frequency induction heating.

15. The process for improving the sag-resistance of steel of claim 11, wherein the steel is heated by direct current heating.

* * * * *